US005251880A

United States Patent [19]

Ishii et al.

[11] Patent Number: 5,251,880

[45] Date of Patent: Oct. 12, 1993

[54] COOLING SYSTEM AND COOLING METHOD FOR HOT ISOSTATIC PRESSURIZING EQUIPMENT

[75] Inventors: Takahiko Ishii; Tomomitsu Nakai, both of Kobe, Japan

[73] Assignee: Kabushiki Kaisha Kobe Seiko Sho, Kobe, Japan

[21] Appl. No.: 842,990

[22] Filed: Feb. 28, 1992

[30] Foreign Application Priority Data

Mar. 4, 1991 [JP] Japan ..... 3-011028

[51] Int. Cl.[5] ..... C21D 1/06

[52] U.S. Cl. ..... 266/44; 266/252; 266/254

[58] Field of Search ..... 266/252, 251, 254, 44; 432/205, 251

[56] References Cited

U.S. PATENT DOCUMENTS 4,217,087 8/1980 Bowles .
4,349,333 9/1982 Bowles .
4,532,984 8/1985 Smith, Jr. .
4,968,009 11/1990 Asari et al. ..... 266/252

FOREIGN PATENT DOCUMENTS 0145417 6/1985 European Pat. Off. .
0185947 7/1986 European Pat. Off. .
0395884 11/1990 European Pat. Off. .
2352585 12/1977 France .
59-87032 5/1984 Japan .
63-123999 8/1988 Japan .
63-125794 8/1988 Japan .
1-230984 9/1989 Japan .

*Primary Examiner*—S. Kastler
*Attorney, Agent, or Firm*—Oblon, Spivak, McClelland, Maier & Neustadt

[57] ABSTRACT

A cooling system for the hot isostatic pressurizing equipment which is provided with valves and actuators at the lower part of the equipment so that they are not subject to thermal deformation. The valves and actuators are installed independently from each other so as to eliminate a need for increasing the diameter of the vessel.

The valve is attached to a lower vent hole formed in the radial direction in the supporting cylinder installed on the inner bottom closure. The valve is energized in its closing direction by a spring and is operated by the actuator installed on the outer bottom closure detachable from the inner bottom closure.

11 Claims, 3 Drawing Sheets

COOLING SYSTEM AND COOLING METHOD FOR HOT ISOSTATIC PRESSURIZING EQUIPMENT

BACKGROUND OF THE INVENTION

1. Field of the Invention

The present invention relates to a cooling system and cooling method for the hot isostatic pressurizing (HIP) equipment.

2. Description of the Prior Art

One of the disadvantages of HIP processing is the lengthy cycle time. One way to reduce the cycle time is to shorten the cooling time after heating as far as possible. This is usually accomplished by rapidly cooling the hot gas used for heating. The cooling method involves releasing the hot gas from the heat-insulated furnace through a vent hole formed in the top of the heat insulator, introducing the released hot gas into a high-pressure chamber, and causing the hot gas to circulate therein by forced or natural convection so that the hot gas undergoes heat exchange with the high-pressure vessel and top closure.

A cooling system for this method is disclosed in Japanese Utility Model Laid-open No. 123999/1988. It comprises a stirring fan for uniform cooling in the furnace and an inner bottom closure which can be removed downward together with a processed workpiece placed thereon, with the heater remaining in the vessel. This arrangement facilitates the handling of the workpiece.

A disadvantage of this prior art technology is that the valve to release hot gas is subject to damage due to thermal deformation because it is attached to the top of the heat insulator and hence is exposed to hot gas. Another disadvantage is that the heat insulator is deformed by the axial force which is applied as the valve is actuated, because the axial force of the actuator is supported by the heat insulator.

A device to overcome these disadvantages is disclosed in Japanese Patent Laid-open No. 87032/1984. It comprises a damper ring which is attached to the lower part of the furnace to avoid the effect of hot gas. A disadvantage of this device is that the damper (including the actuator) needs a large space for its accommodation which makes it necessary to increase the diameter of the vessel. This disadvantage is economically serious in the case of HIP equipment designed for high pressure in excess of 100 MPa.

SUMMARY OF THE INVENTION

It is an object of the present invention to provide a cooling system for the HIP equipment which is designed such that the valve and its actuator are protected from deformation by hot gas and accommodated without any adverse effect on the mechanism of discharging the workpiece through the bottom and without a need for increasing the diameter of the vessel.

The cooling system of the present invention is intended for the HIP equipment. The HIP equipment has a high-pressure chamber formed by a high-pressure vessel, a top closure, and a bottom closure (which is composed of an inner bottom closure and an outer bottom closure). The high-pressure chamber accommodates an insulation mantle provided with a heater on the inside thereof. The insulation mantle accommodates a furnace in which a workpiece undergoes HIP processing by a gaseous pressure medium. After the completion of HIP processing, the hot gas is released through a vent hole formed in the upper part of the furnace. The released hot gas is introduced into the passage outside the furnace and then returned to the furnace through a vent hole formed in the lower part of the furnace. At the same time, the hot gas is stirred in the furnace. Thus, the hot gas is cooled while it is circulated and stirred as mentioned above.

The cooling system of the present invention is characterized by that the above-mentioned lower vent hole is formed in the radial direction in the supporting cylinder attached to the inner bottom closure, and is provided with a valve which is energized in the closing direction and opened by an actuator mounted on the outer bottom closure detachable from the inner bottom closure.

The cooling system of the present invention functions as follows after the HIP processing which involves pressurizing the gaseous pressure medium and heating a workpiece by the electrified heater in the furnace. With the heater turned off, the actuator works to open the valve, so that the gas circulates. During circulation, the gas cools down rapidly by heat exchange. If uniform cooling in the furnace is necessary, the stirring fan is turned on to bring about a forced flow in the furnace.

During HIP processing and gas cooling, the lower part of the high-pressure vessel is kept at a comparatively low temperature, so that the actuator is hardly liable to deformation. In addition, during HIP processing, the actuator does not exert any axial force on the insulation mantle to deform it. Besides, the actuator is separate from the valve but is attached to the outer bottom closure. This permits the high-power actuator to be installed without a need for increasing the diameter of the vessel (high-pressure vessel) and also for abandoning the bottom-discharging structure.

DESCRIPTION OF THE PREFERRED EMBODIMENTS

Figure 1:
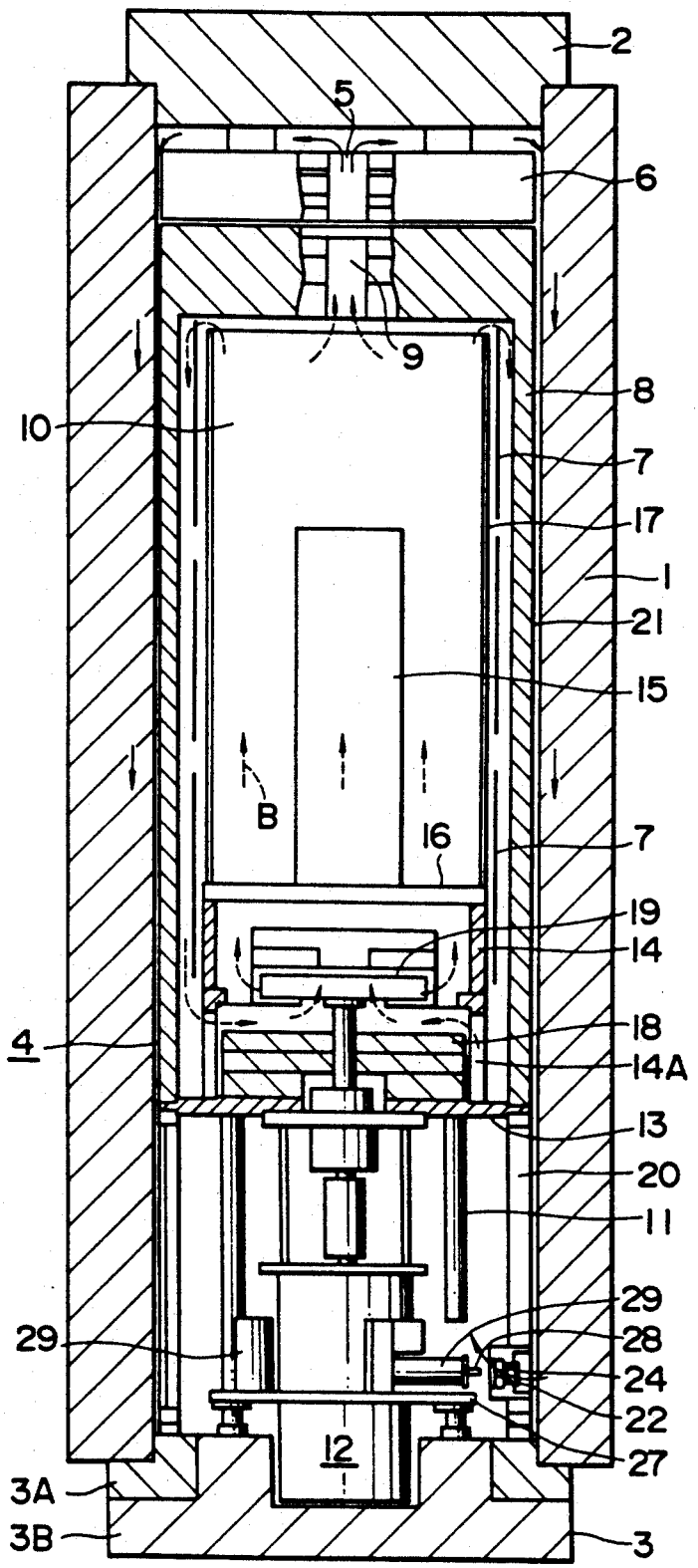
FIG. 1 is a vertical sectional view of an embodiment of the present invention.

The invention will be described in more detail with reference to the accompanying drawings. Referring first to FIG. 1, there is shown a vertical sectional view of the entire structure which includes a high-pressure vessel 1, and a top closure 2 and bottom closure 3 which are hermetically fitted into the top and bottom openings of the high-pressure vessel 1, respectively, the high-pressure vessel 1 and the top and bottom closures 2, 3 forming a high-pressure chamber 4. The bottom closure 3 is made up of a circular inner bottom closure 3A fixed to the lower end of the high-pressure vessel 1 and an outer bottom closure 3B detachably fitted into the opening of the inner bottom closure 3A.

The high-pressure chamber 4 accommodates a heat sink and an insulation mantle 8. The heat sink 6 is attached to the top closure 2, with a passage 5 interposed between them. The insulation mantle 8 takes on a shape of an inverted glass and has a heater 7 on its inside and a vent hole 9 in its upper part. The insulation mantle 8 forms a furnace 10.

In the furnace 10 are placed a pedestal 13 and a holder 16 for a workpiece 15. The pedestal 13 is supported by an underframe 11 standing on the outer bottom closure 3B. The pedestal 13 also has an opening in which the stirring motor 12 is positioned. The holder 16 is supported by a supporting cylinder 14 and an underframe 14A standing on the pedestal 13. On the holder 16 stands a guide cylinder 17 which surrounds the workpiece 15.

The pedestal 13 is provided with a lower heat insulator 18 through which passes a motor shaft for a stirring fan 19. The insulation mantle 8 is supported by a supporting cylinder 20 standing on the inner bottom closure 3.

The above-mentioned construction permits the workpiece 15 to be charged to and discharged from the furnace 10 in the vertical direction as the outer bottom closure 3B is attached to and detached from the HIP equipment. The outer bottom closure 3B moves together with the guide cylinder 17, stirring motor 12, etc. with the heater 7 and insulation mantle 8 remaining in place.

Incidentally, during HIP processing, the top closure 2 and bottom closure 3 are acted on by an axial force, which is supported by a detachable press frame (not shown).

Figure 2:
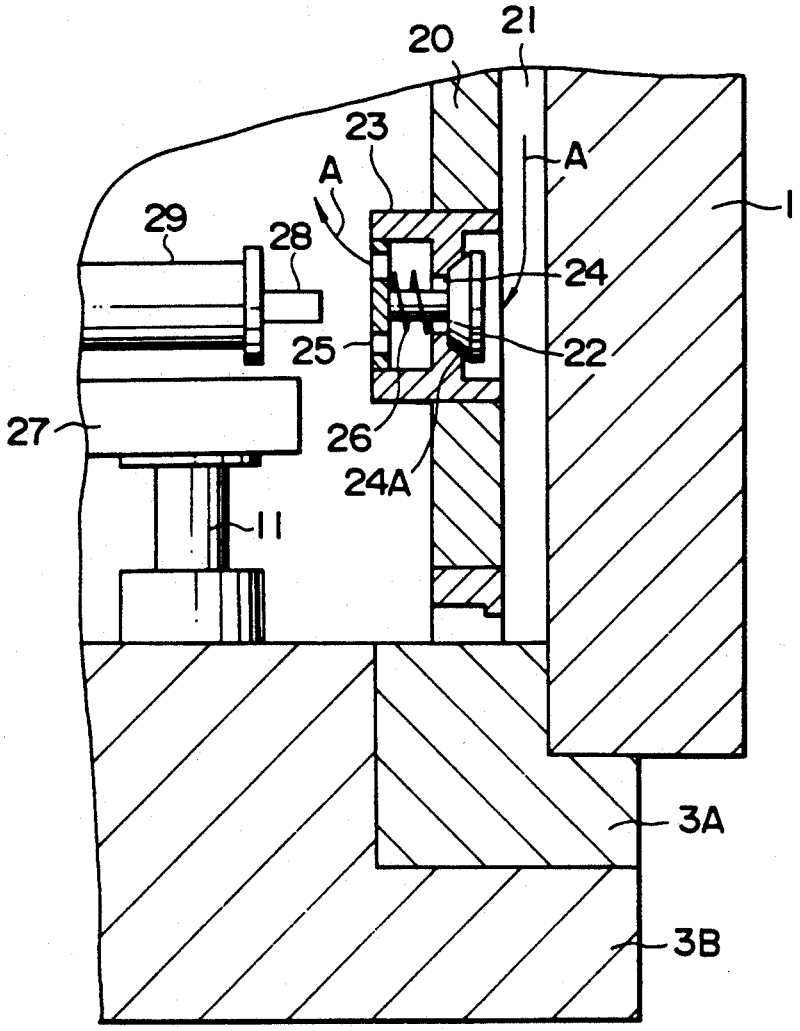
FIG. 2 is an enlarged sectional view of an embodiment of the present invention.

Referring to FIG. 2, there is shown a valve 22 which connects and disconnects a passage 21 outside the furnace and the lower part of the furnace. The passage 21 is formed between the high-pressure vessel 1 and the insulation mantle 8 and supporting cylinder 20. There are a plurality of valves 22 which are arranged radially in the supporting cylinder 20 (as viewed from the top).

The valve 22 is of the poppet valve type. It has the head which closes and opens the lower vent hole 24 formed in the valve box 23 fixed to the supporting cylinder 20. The vent hole 24 has the seal surface 24A. The stem of the valve 22 is provided with a guide flange having through-holes 25. Also, the stem of the valve 22 is wound by a spring 26 which pushes the valve head against the seal surface 24.

Each valve 22 faces an actuator 28, which is positioned in the radial direction on a support 27 attached to the underframe 11. The actuator 28 opens the valve 22 by a motor-driven cylinder 29, in opposition to the force of the spring 26.

Figure 3:
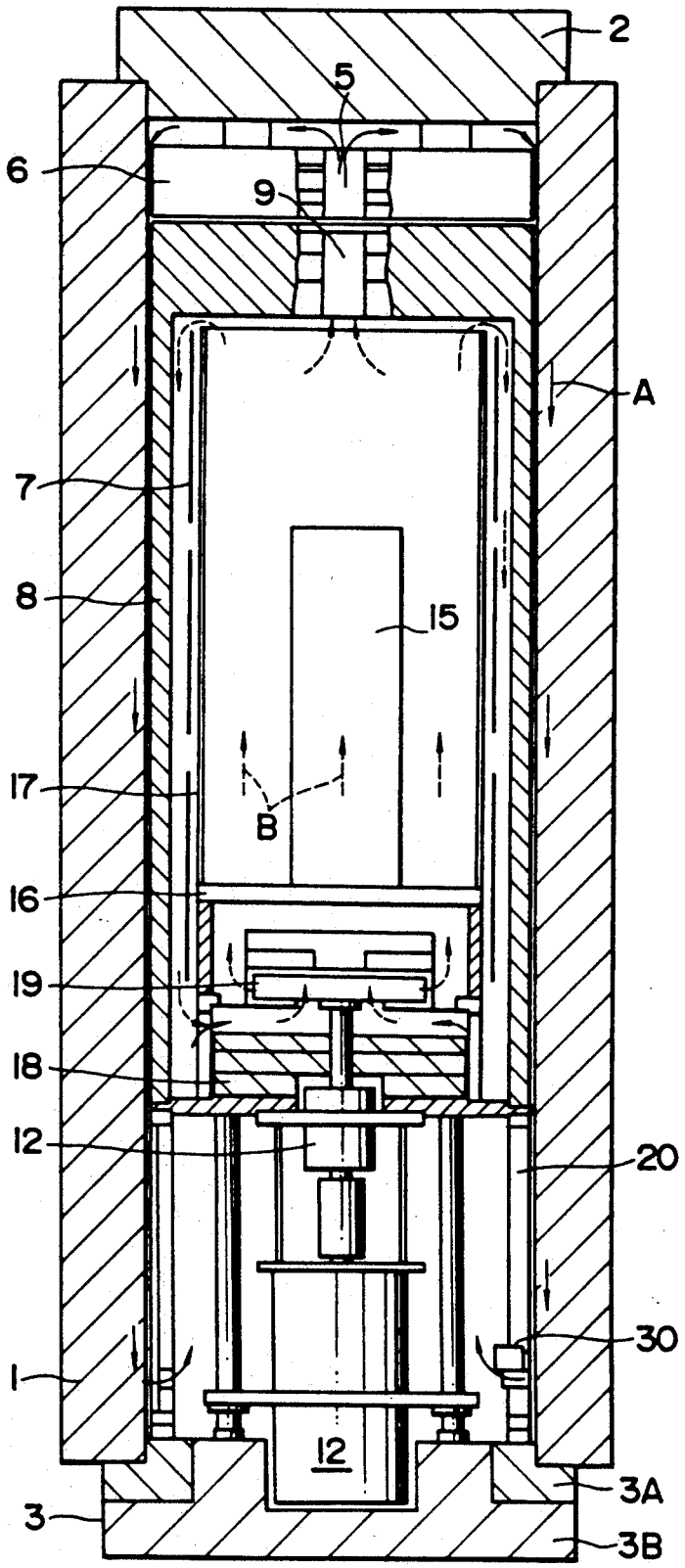
FIG. 3 is a vertical sectional view of a comparative embodiment.

The above-mentioned opening and closing means (consisting of the value 22 and actuator 28) may be replaced by a rotary solenoid-operated one 30 attached to the supporting cylinder 20 as shown in FIG. 3. However, it has a disadvantage that the actuator is inevitably too small to provide sufficient closing force. This is not the case with the present invention, in which the valve 22 is attached to the supporting cylinder 20 and the actuator 28 is attached to the outer bottom closure 3B, so that the valve 22 and the actuator 28 are separate from each other. This arrangement permits the actuator 28 to be removed downward and also permits the mounting of a large actuator which produces larger acting force. Incidentally, like reference characters designate like or corresponding parts in FIGS. 2 and 3.

According to the above-mentioned embodiment of the present invention, HIP processing is performed on the workpiece 15 placed in the furnace 10, with the gaseous pressure medium pressurized in the furnace 10 and the heater 7 electrified. During HIP processing, the valve 22 is kept closed by the spring 26.

After the completion of HIP processing, the cooling cycle starts in the following manner.

First, the motor-driven cylinder 29 is turned on, so that it moves the actuator 28 forward. The actuator 28 pushes the valve 22 in opposition to the force of the spring 26, so that the valve head separates from the seal surface 24A of the valve box 23. Thus the lower vent hole 24 is opened.

This valve opening brings about a circulating flow A (indicated by solid line arrows in FIG. 1) through the vent hole 9, the passage 5, the passage 21, and the lower vent hole 24. The circulating flow causes the hot gas to contact with the heat sink 6 and the inner wall of the high-pressure vessel 1. Thus the hot gas is cooled by heat exchange with them. At the same time, the stirring motor 12 is turned on, so that the stirring fan 19 brings about a stirred flow of the hot gas (indicated by dashed line arrows in FIG. 1) to keep the temperature uniform in the furnace. In this way, rapid uniform cooling proceeds.

After the cooling cycle is complete, the actuator 28 is retracted and then removed downward as the outer bottom closure 3B is detached downward to discharge the HIP-processed workpiece 15, with the valve 22, heater 7, and insulation mantle 8 remaining in place.

As mentioned above, the cooling system of the present invention permits, after HIP processing, the rapid cooling of the hot gas by circulating and stirring the hot gas. During the cooling cycle the valves to close and open the furnace and the actuators are protected from high temperature because they are installed at the lower part of the HIP equipment.

In addition, the actuators are installed such that they do not exert their working force on the insulation mantle in the axial direction. This is effective in protecting the insulation mantle from deformation.

According to the present invention, the valve is installed on the supporting cylinder standing on the inner bottom closure, whereas the actuator is installed on the detachable outer bottom closure, so that they are separate from each other. This construction permits the actuator to be removed downward together with the outer bottom closure. This leads to easy handling.

What is claimed is:

1. A cooling system for the hot isostatic pressurizing equipment having a high-pressure vessel, a top closure fitted into an upper opening of the high-pressure vessel, a bottom closure fitted into a lower opening of the high-pressure vessel, the bottom closure consisting of an inner bottom closure and an outer bottom closure which are detachable from each other, an insulation mantle installed above the inner bottom closure and provided with a heater on the inside thereof, the insulation mantle being placed in a high-pressure chamber formed by the high-pressure vessel and the top and bottom closures, the insulation mantle forming a furnace in which a workpiece undergoes hot isostatic pressurizing by gas pressure, a workpiece holder supported in said furnace by said outer bottom closure for movement with said outer bottom closure independently of movement of said inner bottom closure, said cooling system comprising:

an upper vent hole formed in the upper part of the furnace, a passage formed between the high-pressure chamber and the insulation mantle, a lower vent hole formed in the lower part of the furnace, a valve attached to the lower vent hole, and an actuator for mechanically engaging and actuating the valve installed on the outer bottom closure, wherein the upper vent hole, the passage, the lower vent hole, and the furnace permit the circulation of gas, thereby cooling the workpiece after hot isostatic pressurizing.

2. A cooling system for the hot isostatic pressurizing equipment as defined in claim 1, wherein a plurality of the valves and actuators are arranged radially as viewed from the top.

3. A cooling system for the hot isostatic pressurizing equipment as defined in claim 1, wherein the actuator is a motor-driven cylinder.

4. A cooling system for the hot isostatic pressurizing equipment as defined in claim 1, wherein the valve is installed in a supporting cylinder held between the insulation mantle and the inner bottom closure.

5. A cooling system for the hot isostatic pressurizing equipment as defined in claim 1, wherein the valve is energized in its closing direction.

6. A cooling system for the hot isostatic pressurizing equipment as defined in claim 5, wherein the valve is made up of a valve box attached to the supporting cylinder, a seal surface of the lower vent hole formed in the valve box, a valve head to close and open the seal surface, a valve stem fixed to the valve head, a guide flange with through holes attached to the end of the valve stem, and a spring attached to the guide flange which presses the valve head against the seal surface.

7. A cooling system for the hot isostatic pressurizing equipment as defined in claim 1, which further comprises a stirring fan installed in the lower part of the furnace.

8. A cooling system for the hot isostatic pressurizing equipment as defined in claim 7, which further comprises a guide cylinder which surround the workpiece.

9. A cooling system for the hot isostatic pressurizing equipment as defined in claim 1, which further comprises a heat sink installed between the top closure and insulation mantle, with a passage formed between them.

10. A method for cooling a workpiece placed in a furnace of the hot isostatic pressurizing equipment having a high-pressure vessel, a top closure fitted into the upper opening of the high-pressure vessel, a bottom closure fitted into the lower opening of the high-pressure vessel, the bottom closure consisting of an inner bottom closure and an outer bottom closure, an insulation mantle installed above the inner bottom closure and provided with a heater on the inside thereof, the insulation mantle forming a furnace, an upper vent hole formed in the upper part of the furnace, a passage formed between the high-pressure chamber and the insulation mantle, a lower vent hole formed in the lower part of the furnace, a valve attached to the lower vent hole, and an actuator for mechanically engaging and actuating the valve installed on the outer bottom closure, said method comprising the steps of:

placing a workpiece in the furnace supported by the outer bottom closure, introducing a high pressure gas into the furnace and electrifying the heater, with the valve closed, thereby performing hot isostatic pressurizing on the workpiece, opening the valve by the actuator, thereby causing the gas to circulate through the upper vent hole, the passage, the lower vent hole, and the furnace, thereby cooling the workpiece, closing the valve by the actuator, and discharging the processed workpiece from the furnace together with only the outer one of the bottom closures.

11. A cooling method as defined in claim 10, wherein the step for causing the gas to circulate is accompanied by gas stirring by the stirring fan installed at the lower part of the furnace.

* * * * *